US006070645A

United States Patent [19]

Pleschiutschnigg

[11] Patent Number: 6,070,645

[45] Date of Patent: Jun. 6, 2000

[54] DEVICE FOR MANUFACTURING A POLYGONAL OR SECTIONAL SHAPE IN A CONTINUOUS CASTING PLANT

[75] Inventor: Fritz-Peter Pleschiutschnigg, Duisburg, Germany

[73] Assignee: SMS Schloemann-Siemag Aktiengesellschaft, Düsseldorf, Germany

[21] Appl. No.: 08/934,951

[22] Filed: Sep. 22, 1997

[30] Foreign Application Priority Data

Sep. 25, 1996 [DE] Germany ..... 196 39 299

[51] Int. Cl.[7] ..... B22D 11/04

[52] U.S. Cl. ..... 164/416; 164/418; 164/436

[58] Field of Search ..... 164/459, 418, 164/478, 416, 436, 491

[56] References Cited

U.S. PATENT DOCUMENTS

| | | | |
|---|---|---|---|
| 4,716,955 | 1/1988 | Fastert | 164/418 X |
| 5,188,167 | 2/1993 | Perry et al. | 164/418 |
| 5,520,242 | 5/1996 | Streubel et al. | 164/459 X |
| 5,839,503 | 11/1998 | Pleschiutschnigg | 164/418 X |

FOREIGN PATENT DOCUMENTS

| | | |
|---|---|---|
| 2923111 | 12/1979 | Germany . |
| 4139242 | 9/1993 | Germany . |
| WO93/04802 | 3/1993 | WIPO . |
| WO95/20443 | 8/1995 | WIPO . |

*Primary Examiner*—J. Reed Batten, Jr.
*Attorney, Agent, or Firm*—Friedrich Kueffner

[57] ABSTRACT

The continuous casting plant includes a continuous casting mold having a round mold shape or also an oval mold shape in the upper mold half and a shaping portion starting at the latest in the middle of the mold, wherein the shaping portion has over the lower mold half up to at the latest the mold exit a polygonal shape or sectional shape with approximately the same circumference as the initial round mold shape.

8 Claims, 2 Drawing Sheets

1
2
3
4
5
5,1
5,2
6
7
7,1
7,2
8
8,1
9
9,1
10
11
11,1
12
13
14
15

DEVICE FOR MANUFACTURING A POLYGONAL OR SECTIONAL SHAPE IN A CONTINUOUS CASTING PLANT

BACKGROUND OF THE INVENTION

1. Field of the Invention

The present invention relates to a method for manufacturing slabs suitable for rolling long products, particularly wire, sectional steel, bar steel, rails or the like by means of a continuous casting plant with casting mold. The present invention also relates to a continuous casting plant with mold for carrying out the method.

2. Description of the Related Art

When casting slabs which are required for rolling long products, such as, wire, section steel, rod steel and rails, usually square billets and blooms are cast. The sizes of the square billets are in the dimensional range of between 60 and 200 mm, primarily about 100 mm, and the blooms have dimensions of, for example, 250×320 mm.

In continuous billet casting plants, casting is usually carried out with an open pouring stream between the distributor and the mold and with oil as lubricant. On the other hand, in continuous bloom casting plants, casting is carried out with submerged pouring pipes and casting powder. These continuous casting plants primarily are curved strand continuous casting plants with vertically arranged mold, wherein these plants, in turn, are to be subdivided in vertical plants, vertical bending plants and circular arc-type plants.

Moreover, to a certain but small extent, blooms are also cast in horizontal continuous casting plants. The slabs cast by means of these plants primarily are of special steels which in the casting state can only absorb small bending loads.

Depending on the dimensions of the slabs, the continuous casting plants described above are operated with a maximum operationally realistic casting speed of about 1.5–3.0 m/min.

Contrary to continuous billet and bloom casting plants, due to the round shape in the mold, particularly in the area of the meniscus, continuous round billet casting plants have higher casting speeds of 2–4 m/min. In addition to the possibility of providing an improved uniform slag lubrication and, thus, a more uniform and reduced heat removal with the use of a submerged pouring pipe with casting powder, round billet continuous casting plants also result in an improvement of the slab surface and the quality of the slab interior. However, round billets have up to now almost exclusively been used in seamless pipe plants and not in rolling mills for producing wire steel, rod steel or sectional steel. The reasons for this are the better storing and transporting possibilities of square billets or rectangular shapes in the furnaces arranged upstream of the rolling mill, such as continuous-type furnaces and walking beam-type furnaces. This is particularly true for already existing mini-mills or also integrated metallurgical plants which between the continuous casting plant and the rolling mill frequently operate a continuous-type furnace which is supplied through an intermediate storage.

A possible solution for the object of combining the advantages of a round continuous casting mold and a square billet is described in patents DE 4139242 and WO 93/04802. Another object of these inventions is to improve the internal quality of the slab by reducing the cross-section during the solidification underneath the mold in the area of the slab guide means. In this case, underneath the oval or round continuous casting mold, the slab is shaped by means of stands into a polygonal or billet shape. Three stands are required for this purpose, wherein, due to ruptures of the slab, the stands are very endangered especially underneath the mold, and wherein the stands increase the operating costs as well as the investment costs of the continuous casting plant. In addition, it is to be pointed out that with increasing distance underneath the mold, the slab shell becomes thicker and colder and is more difficult to shape as a result.

SUMMARY OF THE INVENTION

Therefore, it is the primary object of the present invention to provide a solution which provides the advantages of a round mold as well as the advantages of a square billet with a minimum use of additional devices, such as, shaping stands in the slab guide means.

In accordance with the present invention, the slab has at the beginning of its solidification in the mold a round shape or also an oval shape and this round shape or oval shape is shaped along the remaining mold length up to the mold exit to a polygonal slab shape or sectional slab shape having essentially the same circumference.

The continuous casting plant according to the present invention includes a continuous casting mold having a round mold shape or also an oval mold shape in the upper mold half and a shaping portion starting at the latest in the middle of the mold, wherein the shaping portion has over the lower mold half up to at the latest the mold exit a polygonal shape or sectional shape with approximately the same circumference as the initial round mold shape.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figures 1A, 1B:
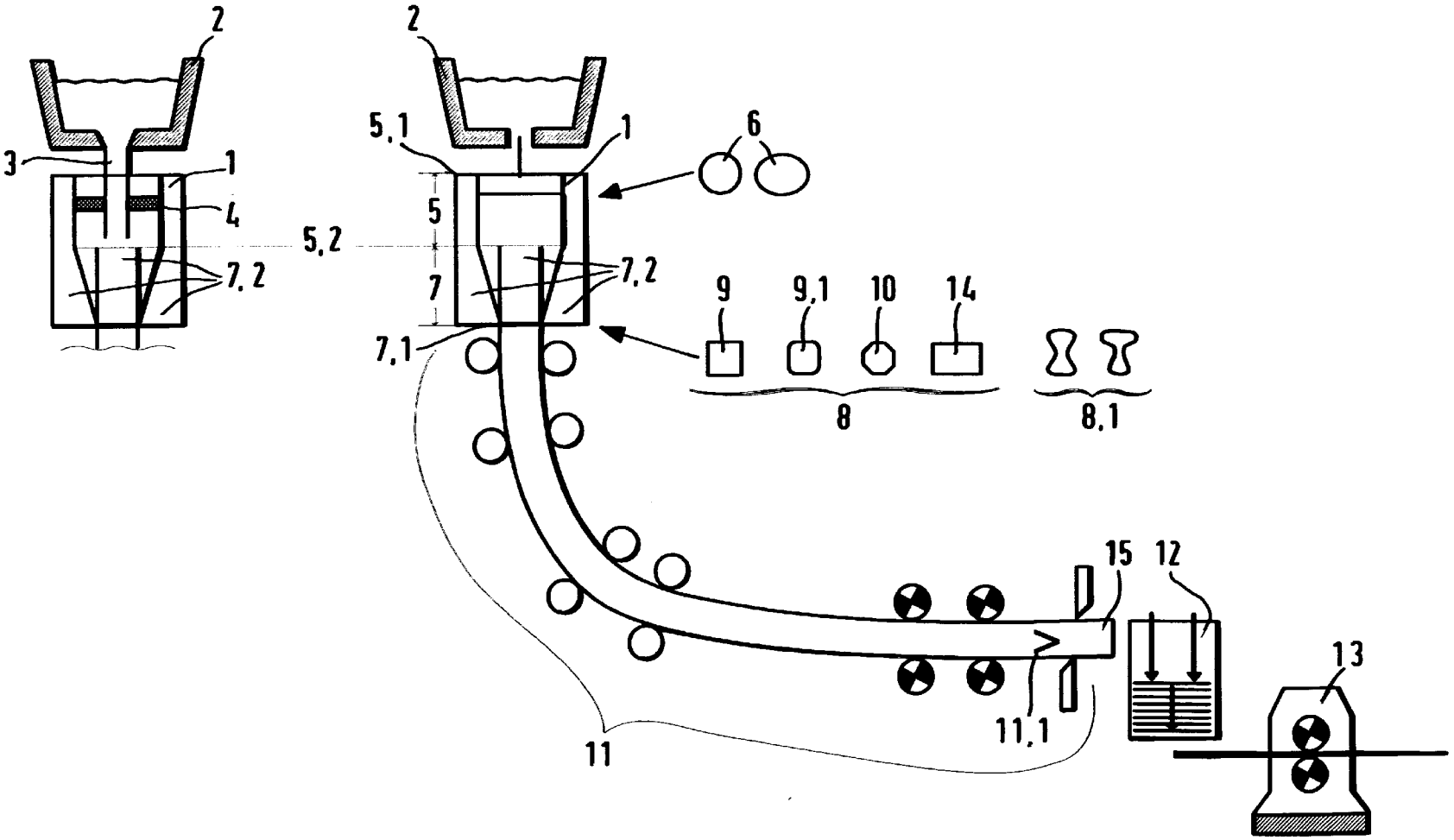
FIG. 1A is a sectional view of a first embodiment of the mold according to the present invention arranged vertically.
FIG. 1B is a sectional view of another embodiment of the mold according to the present invention arranged vertically, for example, in a curved slab continuous casting plant.

FIGS. 1A and 1B of the drawing show a continuous casting plant with an oscillating mold 1 in accordance with the present invention, wherein the mold 1 is supplied with molten steel from a distributor 2. The steel can either be poured freely from the distributor 2 as shown in FIG. 1B, or the steel can be introduced into the mold 1 by means of a submerged pouring pipe 3 with the use of casting powder 4, as shown in FIG. 1A.

In accordance with the present invention, the mold 1 has in the upper half 5 thereof from the upper rim 5.1 to at most the mold middle 5.2 a round or oval shape 6 of, for example, 127 mm, and, extending in the second half 7 to the mold exit 7.1, the slab is shaped into a polygonal shape 8 having the same circumference or a sectional shape 8.1 having the same circumference.

For example, the 127 mm round shape 6 can be shaped into a 100 mm square billet 9 which has the same circumference of 400 mm as the 127 mm round shape.

In addition, the square billet easily may have convex surfaces and/or rounded edges 9.1. Also, the round shape may be shaped in the mold into a polygonal shape 10, for example, an octahedron, having the same circumference.

The slab can be easily shaped from a round shape 6 to a polygonal shape 8 or sectional shape 8.1 within the continuous casting mold because the slab with its hot slab shell and the liquid core is very ductile, has a low resistance to deformation and conforms easily to the shape of the mold.

The billet shaped in this manner then reaches complete solidification 11.1 on the conventional continuous casting plant 11 and is conveyed to the rolling mill 13 and the furnace 12 arranged in front of the rolling mill 13. When the continuous casting plant is advantageously arranged and the slab cross section is advantageously selected relative to the slab surface, the furnace 12 can be a pure temperature holding furnace which does not have to supply energy to the slab.

The continuous casting plant may be a billet plant as well as a bloom plant. For example, a typical bloom plant casts a slab having a rectangular shape of 320×250 mm which is used, for example, for the production of rails. In accordance with the present invention, the corresponding round shape at the meniscus of the mold has a diameter of 363 mm and is shaped in the mold to a bloom 14 of 320×250 mm having the same circumference. On the other hand, if a sectional shape 8.1 is shaped in the mold for the production of rails, the round section having the same circumference can be smaller in accordance with the roll stands which are not required.

Such a casting shape 8.1 which is closer to the final dimensions would correspond, for example, to the eighth intermediate section within a classical rail calibration of 18 passes, so that the elongation of the rolling stock can be reduced from about 10 to 6 while ensuring the rail quality.

In addition, the second portion of the mold which carries out the shaping of the slab may be composed of mold segments. Shaping is then carried out by means of cooled segment plates 7.2 which are position-controlled and force-controlled.

For reducing the friction, it is also possible to build up a gas film between the mold plates and the slab, wherein the gas film supports sliding of the slab and reduces the wear of the mold plates. The mold segments 7.2 are preferably of copper, but they may also be of cast steel.

FIG. 2 of the drawing shows that the mold according to the present invention can also be used in horizontal continuous casting plants.

Figure 2A:
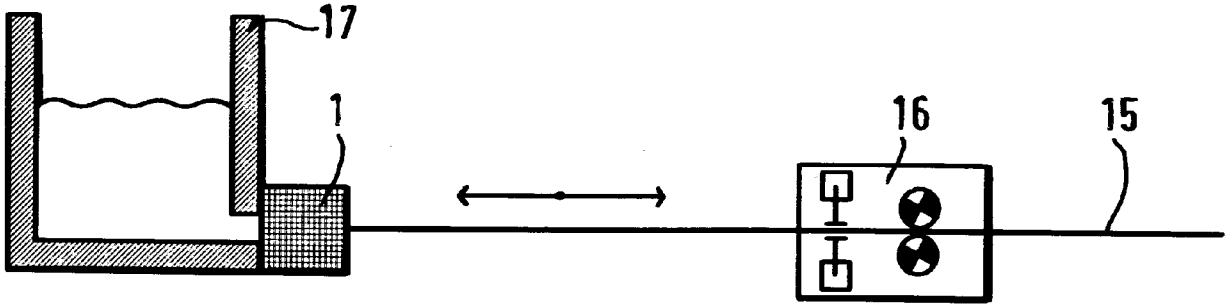
FIG. 2A is a schematic illustration of a horizontal continuous casting plant with an oscillating slab.
Figure 2B:
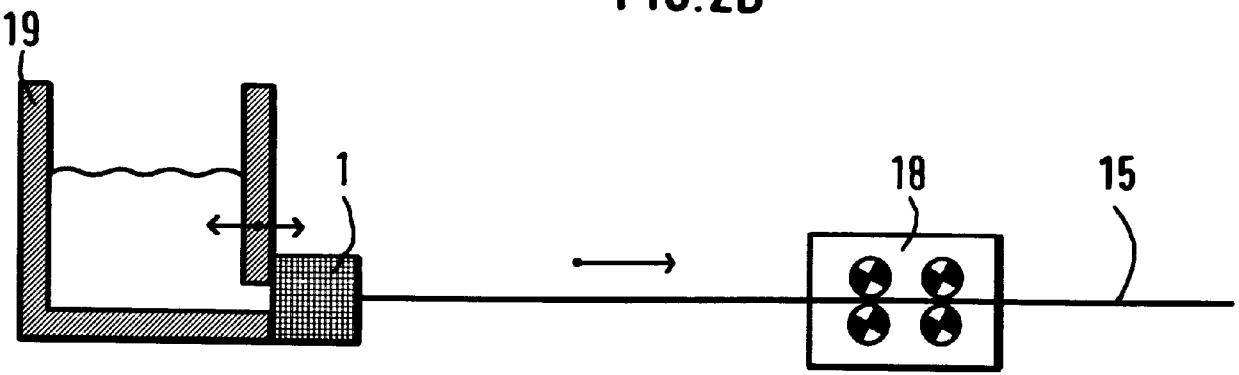
FIG. 2B is a schematic illustration showing a horizontal continuous casting plant with an oscillating mold.

As shown in FIG. 2A, the slab 15 can be moved out of the mold 1, which is rigidly connected to the distributor 17, by means of the withdrawal machine 16 with hydraulic clamping jaw drive or electric roller drive. On the other hand, as shown in FIG. 2B, the slab 15 can be moved out of the oscillating mold 1 having a distributor 19 flanged thereon by means of the withdrawal machine 18 with electric roller drive.

The present invention provides the advantage that the casting speed can be substantially raised to a maximum of 10 m/min and, thus, the productivity of the continuous casting plant is improved. Simultaneously, the invention requires a minimum additional investment and in the first approximation the operating costs are unchanged as compared to a conventional continuous casting plant with rectangular slab shapes.

The present invention also makes it possible to refit already existing continuous casting plants in a simple manner in order to improve the slab quality in the interior thereof as well as on the surface.

In summary, it is possible to state that the invention is of technical and economical interest for refitting already existing continuous casting plants as well as for new plants.

The invention is not limited by the embodiments described above which are presented as examples only but can be modified in various ways within the scope of protection defined by the appended patent claims.

I claim:

1. A continuous casting plant for manufacturing slabs suitable for rolling long products, the continuous casting plant comprising a casting mold for casting a slab, the casting mold having an upper mold half and a lower mold half, a mold middle and a mold exit, wherein the mold has in the upper mold half a round mold shape or an oval mold shape, and wherein the mold has a shaping portion extending at least from the middle of the mold along the lower mold half to the mold exit, the shaping portion having at least in the vicinity of the mold exit a polygonal shape or sectional shape having approximately the same circumference as the round mold shape, wherein the lower mold half is comprised of segments which are independent of each other for shaping the slab, and wherein the segments of the mold are position-controlled and force-controlled.

2. The continuous casting plant according to claim 1, wherein the mold has a round cross-section in the upper mold half not exceeding the mold middle.

3. The continuous casting plant according to claim 1, wherein the mold has at the mold exit one of a square billet shape, a convex square billet shape, an octahedral shape, a bloom shape and sectional slab shape.

4. The continuous casting plant according to claim 1, further comprising means for building up a gas film between the segments of the mold and the slab.

5. The continuous casting plant according to claim 1, wherein the segments are of copper, a copper alloy or cast steel.

6. The continuous casting plant according to claim 1, wherein the mold is mounted vertically a n d comprises means for oscillating the mold, and wherein the mold is mounted at the head of a vertical continuous casting plant, a vertical bending continuous casting plant or a curved continuous casting plant for casting billets, blooms or sections.

7. The continuous casting plant according to claim 1, wherein the mold is mounted horizontally and is rigidly connected to a distributor, further comprising an oscillating device for oscillating the slab for moving the slab out of the mold.

8. The continuous casting plant according to claim 1, wherein the mold is mounted horizontally and is rigidly connected to a distributor, further comprising an oscillating device for oscillating the mold and the distributor.

* * * * *